US011525307B2

(12) United States Patent
Schultz

(10) Patent No.: US 11,525,307 B2
(45) Date of Patent: Dec. 13, 2022

(54) FLUID PULSE GENERATION IN SUBTERRANEAN WELLS

(71) Applicant: THRU TUBING SOLUTIONS, INC., Newcastle, OK (US)

(72) Inventor: Roger L. Schultz, Newcastle, OK (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 0 days.

(21) Appl. No.: 17/216,539

(22) Filed: Mar. 29, 2021

(65) Prior Publication Data

US 2021/0301596 A1 Sep. 30, 2021

Related U.S. Application Data

(60) Provisional application No. 63/001,601, filed on Mar. 30, 2020.

(51) Int. Cl.

| | |
|---|---|
| ***E21B 7/24*** | (2006.01) |
| ***E21B 21/08*** | (2006.01) |
| ***E21B 28/00*** | (2006.01) |

(52) U.S. Cl.

CPC ..... *E21B 7/24* (2013.01); *E21B 21/08* (2013.01); *E21B 28/00* (2013.01)

(58) Field of Classification Search

CPC . E21B 7/24; E21B 21/08; E21B 28/00; E21B 34/063; E21B 31/005; E21B 4/06; E21B 4/14

See application file for complete search history.

(56) References Cited

U.S. PATENT DOCUMENTS 4,058,163 A 11/1977 Yandell
4,890,682 A 1/1990 Worrall et al.
(Continued)

FOREIGN PATENT DOCUMENTS

CA 2680895 A1 3/2011
CN 110374508 A 10/2019
(Continued)

OTHER PUBLICATIONS

International Search Report with Written Opinion dated Jun. 30, 2021 for PCT Patent Application No. PCT/US/2021/02165, 13 pages.

(Continued)

*Primary Examiner* — Brad Harcourt
(74) *Attorney, Agent, or Firm* — Smith IP Services, P.C.

(57) ABSTRACT

A fluid pulse generator can include a fluid motor and a bypass flow path in fluid communication with an inlet and an outlet, and a flow control device configured to permit flow through the bypass flow path in response to a predetermined pressure differential applied across the flow control device. A method of generating fluid pulses can include flowing a fluid through a fluid pulse generator, thereby generating fluid pulses, and then applying a predetermined pressure differential from an inlet to an outlet of the fluid pulse generator, thereby permitting flow of the fluid through the fluid pulse generator without generating the fluid pulses. A fluid pulse generation system can include a fluid pulse generator with a fluid motor, a variable flow restrictor, and a bypass flow path. A predetermined pressure differential applied across the fluid motor permits the flow of the fluid through the bypass flow path.

14 Claims, 8 Drawing Sheets

(56) References Cited

U.S. PATENT DOCUMENTS

| | | | |
|---|---|---|---|
| 6,237,701 | B1 | 5/2001 | Kolle et al. |
| 6,279,670 | B1 | 8/2001 | Eddison et al. |
| 6,431,294 | B1 | 8/2002 | Eddison et al. |
| 6,439,318 | B1 | 8/2002 | Eddison et al. |
| 6,508,317 | B2 | 1/2003 | Eddison et al. |
| 7,139,219 | B2 | 11/2006 | Kolle et al. |
| 7,389,830 | B2 | 6/2008 | Turner et al. |
| 7,575,051 | B2 | 8/2009 | Stoesz et al. |
| 8,069,926 | B2 | 12/2011 | Eddison et al. |
| 8,167,051 | B2 | 5/2012 | Eddison et al. |
| 8,181,719 | B2 | 5/2012 | Bunney et al. |
| 8,201,641 | B2 | 6/2012 | Allahar |
| 8,381,817 | B2 | 2/2013 | Schultz et al. |
| 8,439,117 | B2 | 5/2013 | Schultz et al. |
| 8,448,700 | B2 | 5/2013 | Connell et al. |
| 8,453,745 | B2 | 6/2013 | Schultz et al. |
| 8,517,105 | B2 | 8/2013 | Schultz et al. |
| 8,517,106 | B2 | 8/2013 | Schultz et al. |
| 8,517,107 | B2 | 8/2013 | Schultz et al. |
| 8,517,108 | B2 | 8/2013 | Schultz et al. |
| 8,939,217 | B2 | 1/2015 | Kolle |
| 9,194,208 | B2 | 11/2015 | Schultz et al. |
| 9,212,522 | B2 | 12/2015 | Schultz et al. |
| 9,249,642 | B2 | 2/2016 | Kolle |
| 9,273,529 | B2 | 3/2016 | Eddison et al. |
| 9,279,300 | B2 | 3/2016 | Kolle et al. |
| 9,316,065 | B1 | 4/2016 | Schultz et al. |
| 9,382,760 | B2 | 7/2016 | Le et al. |
| 9,593,537 | B2 | 3/2017 | Gust |
| 9,637,976 | B2 | 5/2017 | Lorenson et al. |
| 9,637,991 | B2 | 5/2017 | Eddison et al. |
| 9,915,107 | B1 | 3/2018 | Schultz et al. |
| 10,358,872 | B2 | 7/2019 | Rossing et al. |
| 10,415,324 | B1 | 9/2019 | Schultz et al. |
| 10,465,475 | B2 | 11/2019 | Theimer et al. |
| 10,513,900 | B1 | 12/2019 | Schultz et al. |
| 10,590,709 | B2 | 3/2020 | Sicilian et al. |
| 10,677,006 | B2 * | 6/2020 | von Gynz-Rekowski ..... E21B 7/24 |
| 10,718,168 | B2 | 7/2020 | Donald et al. |
| 10,724,323 | B2 | 7/2020 | Roseman et al. |
| 10,865,612 | B2 | 12/2020 | Elfar |
| 2003/0183388 | A1 | 10/2003 | Toulouse et al. |
| 2006/0243493 | A1 | 11/2006 | El-Rayes et al. |
| 2007/0187112 | A1 | 8/2007 | Eddison et al. |
| 2009/0223676 | A1 | 9/2009 | Eddison et al. |
| 2010/0276204 | A1 | 11/2010 | Connell et al. |
| 2011/0073374 | A1 | 3/2011 | Bunney et al. |
| 2013/0092246 | A1 | 4/2013 | Kolle |
| 2015/0068811 | A1 * | 3/2015 | Marchand ..... E21B 4/02 173/218 |
| 2015/0075867 | A1 * | 3/2015 | Eddison ..... E21B 7/24 175/56 |
| 2015/0101824 | A1 | 4/2015 | Kolle et al. |
| 2016/0108691 | A1 | 4/2016 | Kolle |
| 2018/0171719 | A1 | 6/2018 | Donald et al. |
| 2019/0040697 | A1 * | 2/2019 | Barker ..... E21B 34/10 |
| 2019/0153797 | A1 | 5/2019 | Von Gynz-Rekowski et al. |
| 2019/0257167 | A1 | 8/2019 | Kinsella et al. |
| 2019/0277092 | A1 | 9/2019 | Lebaron et al. |
| 2020/0024924 | A1 | 1/2020 | Clausen et al. |
| 2021/0277743 | A1 | 9/2021 | Schultz et al. |

FOREIGN PATENT DOCUMENTS

| | | | |
|---|---|---|---|
| CN | 110374509 | A | 10/2019 |
| WO | 2015191889 | A1 | 12/2015 |
| WO | 2018006178 | A1 | 1/2018 |
| WO | 2018231244 | A1 | 12/2018 |

OTHER PUBLICATIONS

International Search Report with Written Opinion dated Jul. 6, 2021 for PCT Patent Application No. PCT/US/2021/024736, 11 pages.
Wellbore Technologies; "Agitator Systems", company brochure, dated 2015, 5 pages.
Wellbore Technologies; "AgitatorHE On-Demand Survey", company brochure, dated 2020, 1 page.
Wellbore Technologies; "AgitatorHE On-Demand System", spec sheet, dated 2020, 1 page.
Wellbore Technologies; "Agitator PLUS System", technical summary, dated prior to 2020, 1 page.
Tempress; "HydroPull", company factsheet, dated 2015, 5 pages.
National Oilwell Varco; "Agitator Tool", technical summary, dated 2009, 2 pages.
Tempress; "Tempress HydroPull Tool", company brochure dated prior to 2020, 5 pages.
Office Action dated Oct. 6, 2022 for U.S. Appl. No. 17/193,249, 38 pages.

* cited by examiner

FLUID PULSE GENERATION IN SUBTERRANEAN WELLS

CROSS-REFERENCE TO RELATED APPLICATION

This application claims the benefit of the filing date of U.S. provisional application No. 63/001,601 filed on Mar. 30, 2020. The entire disclosure of the prior application is incorporated herein by this reference.

BACKGROUND

This disclosure relates generally to equipment utilized and operations performed in conjunction with a subterranean well and, in an example described below, more particularly provides for fluid pulse generation in wells.

It can be advantageous to be able to produce pressure and flow pulses in fluid flow through a tubular string in a well. For example, fluid pulses in a fluid flow can cause a "water hammer" effect and vibration of a tubular string, which can help to displace the tubular string through a horizontal section of a wellbore, prevent differential sticking or produce other desirable effects.

Therefore, it will be readily appreciated that improvements are continually needed in the art of generating fluid pulses in subterranean wells. It is among the objects of the present disclosure to provide such improvements to the art for use in any of a wide variety of different types of well operations.

DETAILED DESCRIPTION

Figure 1:
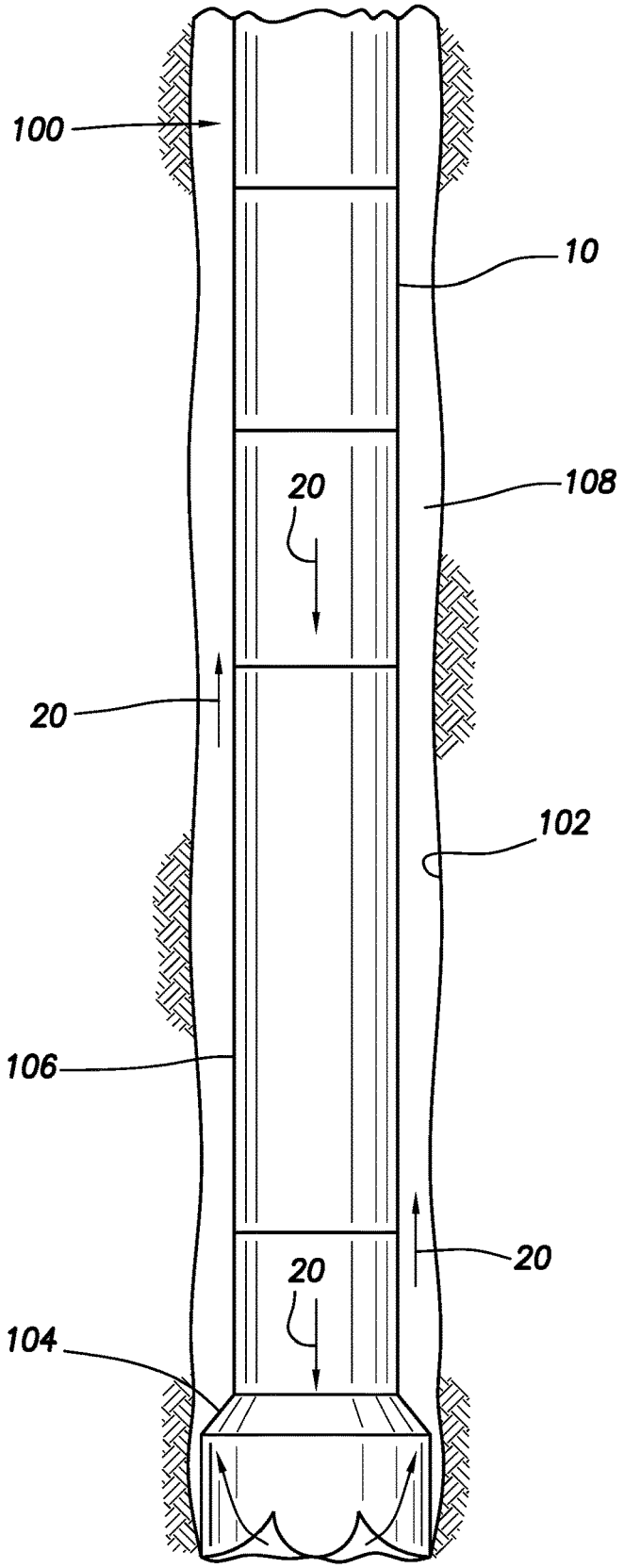
FIG. 1 is a representative partially cross-sectional view of an example of a well system and associated method which can embody principles of this disclosure.

Representatively illustrated in the drawings is a fluid pulse generation system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

Referring specifically to FIG. 1, in this example the system 10 is used with a tubular string 100 in a well drilling operation. The tubular string 100 is of the type known to those skilled in the art as a drill string. In other types of well operations (such as, stimulation, completion, production, injection, etc., operations), other types of tubular strings may be used.

The tubular string 100 in the FIG. 1 example is being used to drill a wellbore 102 further into the earth. The wellbore 102 is depicted in FIG. 1 as being vertical, but in other examples (or in other sections of the wellbore), the wellbore may be horizontal or otherwise inclined from vertical.

As depicted in FIG. 1, the tubular string 100 includes a bottom hole assembly (BHA) connected at a distal end thereof. In this example, the BHA includes a drill bit 104 and a fluid motor 106. Other tools or other combinations of tools (such as, telemetry tools, logging tools, stabilizers, reamers, centralizers, etc.) may be used in other examples.

During the drilling operation, a fluid 20 (sometimes referred to by those skilled in the art as "mud" or drilling fluid) is pumped into the wellbore 102 via the tubular string 100. The fluid 20 exits the tubular string 100 via nozzles (not shown) in the drill bit 104 and returns to surface via an annulus 108 formed between the tubular string and the wellbore 102.

It is important in this example to maintain the flow of the fluid 20 through the tubular string 100 during the drilling operation. For example, the flow of the fluid 20 can be used to operate the fluid motor 106 and thereby rotate the drill bit 104 (e.g., the fluid motor may be a Moineau or turbine type of fluid motor). Alternatively, or in addition, the flow of the fluid 20 may be used in operation of telemetry tools, stabilizers, reamers or other tools, or for well control.

In other examples (such as, in other types of well operations), there may be other reasons that it is desirable to maintain a flow of fluid through a tubular string. Therefore, it should be understood that the scope of this disclosure is not limited to any particular reason for maintaining the flow of a fluid through a tubular string in a well.

In the FIG. 1 example, the fluid pulse generation system 10 may be part of the BHA, or it may be used in another section of the tubular string 100. Multiple fluid pulse generation systems 10 could be used in a tubular string in some examples. Thus, the scope of this disclosure is not limited to use of the fluid pulse generation system 10 in any particular part or section of a tubular string.

The fluid pulse generation system 10 generates pulses in the flow of the fluid 20 through the tubular string 100 in the FIG. 1 example. The pulses may be used for any purpose, such as, to aid advancement of the tubular string 100 through the wellbore 102, to prevent differential sticking, etc. However, the scope of this disclosure is not limited to any particular purpose for generating pulses in fluid flow through a tubular string.

Referring additionally now to FIGS. 2-9, an example of the fluid pulse generation system 10 is representatively illustrated apart from the FIG. 1 tubular string 100 and wellbore 102. The fluid pulse generation system 10 may be used with the FIG. 1 tubular string 100, wellbore 102 and drilling operation, or it may be used with other tubular strings, wellbores or well operations.

Figure 2:
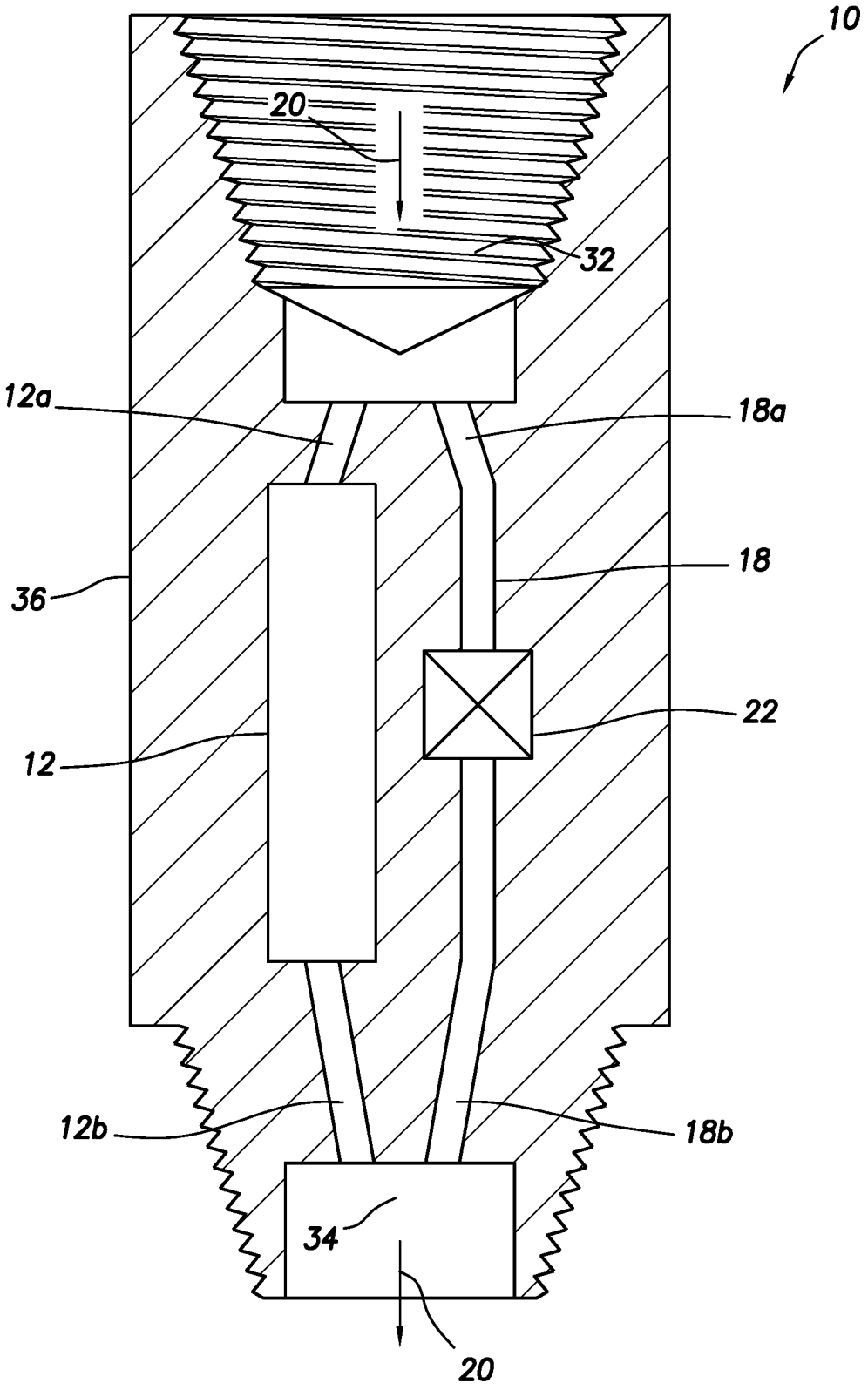
FIG. 2 is a representative schematic cross-sectional view of an example of a fluid pulse generation system that may be used with the FIG. 1 well system and method.

Referring specifically to FIG. 2, a schematic cross-sectional view of the system 10 is representatively illustrated. In this example, the system 10 includes a fluid pulse generator 12 with a bypass flow path 18 connected in parallel with the fluid pulse generator. Thus, an inlet 12*a* of the fluid pulse generator 12 and an inlet 18*a* of the bypass flow path 18 are in communication with an inlet 32 of a housing 36 of the system 10, and an outlet 12*b* of the fluid pulse generator and an outlet 18*b* of the bypass flow path are in communication with an outlet 34 of the housing.

The fluid pulse generator 12 produces pulses in the flow of the fluid 20. Initially, flow of the fluid 20 through the bypass flow path 18 is blocked by a flow control device 22, so that all (or substantially all) of the fluid flows through the fluid pulse generator 12. However, if flow of the fluid 20 through the fluid pulse generator 12 should become blocked, or if it is desired to cease generation of the fluid pulses, the flow control device 22 can be opened to permit relatively unrestricted flow of the fluid 20 through the bypass flow path 18. In this manner, the flow of the fluid 20 through the system 10 can be maintained.

Referring additionally now to FIGS. 3-9, a more detailed example of the fluid pulse generation system 10 is representatively illustrated. In the FIGS. 3-9 system 10, the fluid pulse generator 12 uses a Moineau-type power section or fluid motor 14 upstream of a bearing/variable flow restrictor 16 to cause repetitive flow interruption. In other examples, the fluid motor 14 could include a turbine-type fluid motor, or another type of power section.

The system 10 includes the fluid pulse generator 12 and the parallel bypass flow path 18 that will let the fluid 20 bypass the fluid motor 14 of the fluid pulse generator 12. The bypass flow path 18 can be considered to be incorporated into the fluid pulse generator 12, since the bypass flow path extends longitudinally through the rotor 26 of the fluid motor 14. Thus, it is not necessary for the bypass flow path 18 to be considered a separate element from the fluid pulse generator 12.

In this example, the flow control device 22 opens in response to differential pressure acting across the parallel flow path 18 (e.g., from the inlet 18*a* to the outlet 18*b*). This allows circulation through a bottom hole assembly including the fluid pulse generator 12 to be maintained, even if the fluid motor 14 of the fluid pulse generator becomes plugged, etc. For example, a rupture disc or a mechanically restrained valve or other type of flow control device 22 is used that responds to a predetermined differential pressure level that causes the flow path 18 to permanently open, thereby allowing the fluid 20 to flow through the bypass flow path 18.

The drawings depict a rotary fluid pulse generator 12 which has a Moineau fluid motor 14 driving a variable flow restrictor 16 that includes a moving element and a stationary element. As a rotor 26 of the fluid motor 14 orbits and rotates, an attached upper restrictor element 16*a* moves through open and closed positions relative to a fixed lower restrictor element 16*b*. The restrictor elements 16*a,b* also serve as a bearing set between rotary and fixed components of the fluid pulse generator 12.

There are two separate rupture disks 22*a,b* shown in the drawings as examples of suitable flow control devices for use in the system 10. Other suitable types of flow control devices include pressure relief valves, releasably secured pistons or sleeves, etc. The scope of this disclosure is not limited to use of any particular type of flow control device.

There is one rupture disk 22*a* at a lower end of the fluid pulse generator 12 that, when open, allows fluid 20 to bypass the upper and lower restrictor elements 16*a,b* and flow unimpeded through the fluid pulse generator. There is an annulus 24 that connects the area where fluid 20 is discharged from the fluid motor 14 to the rupture disk 22*a* in a lower connector 38 of the fluid pulse generator 12.

There is another rupture disk 22*b* installed in the top of the rotor 26 which is more specific to fluid pulse generators which have Moineau power sections. There is a tendency in Moineau power sections for the rubber to degrade or fail, causing flow to be blocked by plugging between the rotor and stator. Also, Moineau power sections are prone to seizing, making it difficult or impossible to pump fluid through the power section, effectively blocking flow through the motor and hence the BHA.

The rupture disk 22*b* shown at the top of the rotor 26 can be ruptured by applying a sufficient differential pressure across the fluid motor 14. This will allow fluid 20 to continue to pass through the fluid motor 14 via the bypass flow path 18, even if the motor becomes locked or plugged. The fluid motor 14 is inoperative after the rupture disk 22*b* has been opened by the pressure differential, since the fluid 20 can then flow through the bypass flow path 18, instead of between the rotor 26 and the stator 28.

The drawings depict the flow path 18 extending through a ported component 30 attached to the bottom of the rotor 26. In other examples, ports could be formed directly radially through the rotor 26, without need for a separate component attached to the bottom of the rotor. Additionally, the rupture disc 22*b* could be installed at the bottom of the rotor 26 or anywhere in the flow path 18 connecting area above the rotor to the area below the rotor. The bypass flow path 18 in other examples could be located within the stator 28, instead of the rotor 26.

Figure 3:
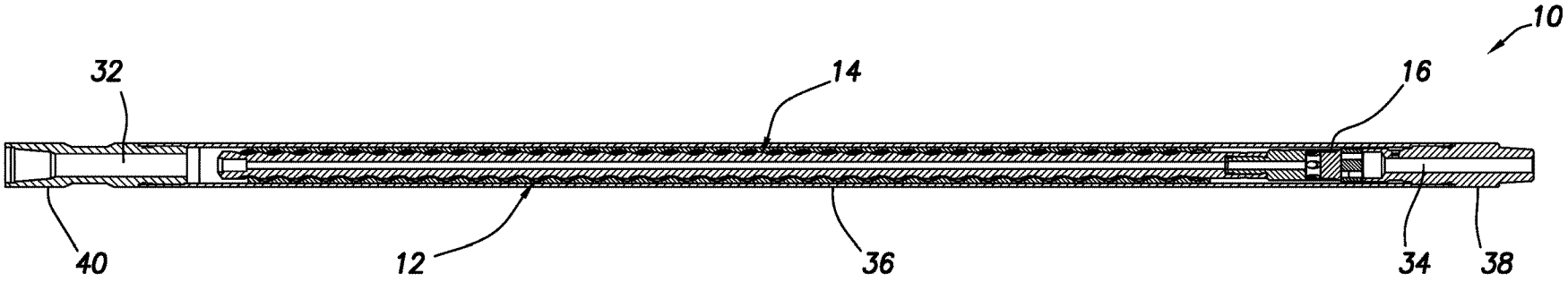
FIG. 3 is a representative cross-sectional view of a more detailed example of the fluid pulse generation system.

Referring specifically now to FIG. 3, it may be seen that the fluid motor 14 is contained within the housing 36, longitudinally between the variable flow restrictor 16 and an upper connector 40. In the FIG. 1 system 10, the upper and lower connectors 40, 38 are configured to connect the fluid pulse generator 12 in the tubular string 100, either as part of the BHA or at another position along the tubular string.

Figure 4:
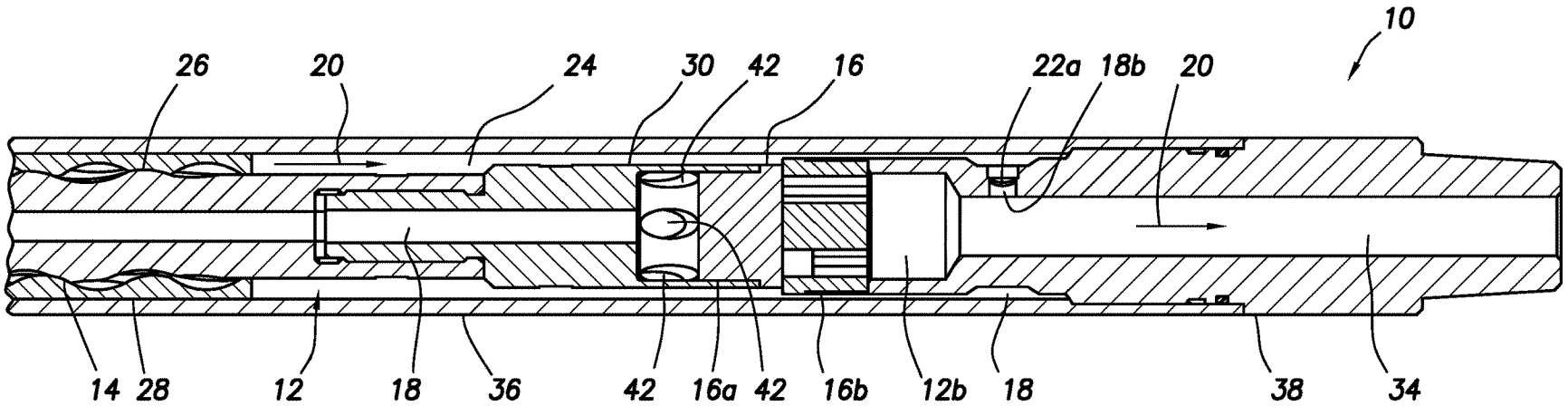
FIG. 4 is a representative cross-sectional view of a lower portion of a fluid pulse generator section of the fluid pulse generation system.

Referring specifically now to FIG. 4, it may be seen that the fluid 20 flows through the fluid motor 14 between the rotor 26 and the stator 28 in operation. The stator 28 is formed in the housing 36. For example, the stator 28 could be molded in the housing 36, the stator could be separately formed and then bonded within the housing, the stator could be machined in the housing, etc. If the fluid motor 14 is a turbine-type motor, the stator 28 could include vanes positioned in the housing 36. The scope of this disclosure is not limited to use of any particular type of fluid motor, rotor or stator, or to any particular configuration or method of forming the rotor or stator.

After flowing between the rotor 26 and the stator 28, the fluid 20 flows through the annulus 24 to the ported component 30. The fluid 20 then flows inward through ports 42 formed radially through the component 30. From an interior of the component 30, the fluid 20 can flow through the upper restrictor element 16*a*.

Depending on a rotary position of the upper restrictor element 16*a* relative to the lower restrictor element 16*b*, the fluid 20 will either be able to flow relatively unrestricted between the upper and lower restrictor elements, or the flow from the upper restrictor element to the lower restrictor element will be blocked or at least substantially restricted. If the flow of the fluid 20 from the upper restrictor element 16*a* to the lower restrictor element 16*b* is relatively unrestricted, the fluid will flow from the variable flow restrictor 16 to the outlet 34 in the lower connector 38. However, if the flow of the fluid 20 from the upper restrictor element 16*a* to the lower restrictor element 16*b* is blocked or substantially restricted, a pressure pulse will be generated in the fluid flow, a "water hammer" effect will result in the fluid flow upstream of the variable flow restrictor 16 and vibration will result in the tubular string in which the fluid pulse generator 12 is connected.

Note that the rupture disk 22*a* initially isolates the annulus 24 from the outlet 34. In some examples, the rupture disk 22*a* could instead be a pressure relief valve, a releasably secured piston or sleeve, or another type of flow control device. The scope of this disclosure is not limited to use of any particular type of flow control device to isolate the annulus 24 from the outlet 34.

Figure 5:
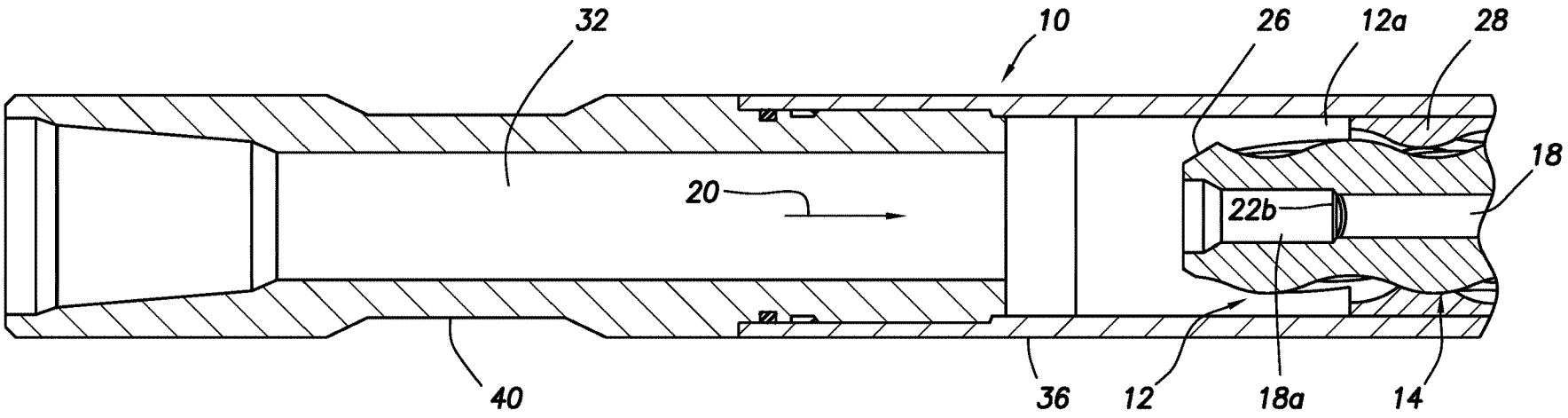
FIG. 5 is a representative cross-sectional view of an upper portion of the fluid pulse generator section.

Referring specifically now to FIG. 5, it may be seen that the rupture disk 22*b* isolates the bypass flow path 18 in the rotor 26 from the inlet 32 in the upper connector 40. In some examples, the rupture disk 22*b* could instead be a pressure relief valve, a releasably secured piston or sleeve, or another type of flow control device. The scope of this disclosure is not limited to use of any particular type of flow control device to isolate the bypass flow path 18 from the inlet 32.

With the rupture disk 22*b* preventing the fluid 20 from flowing through the upper end of the bypass flow path 18, the fluid must flow between the rotor 26 and the stator 28. However, if flow between the rotor 26 and the stator 28 becomes blocked or substantially restricted, a pressure differential can be applied across the rupture disk 22*b*. If the pressure differential is increased to a predetermined level, the rupture disk 22*b* will open and thereby permit the fluid 20 to flow through the bypass flow path 18.

Figure 6:
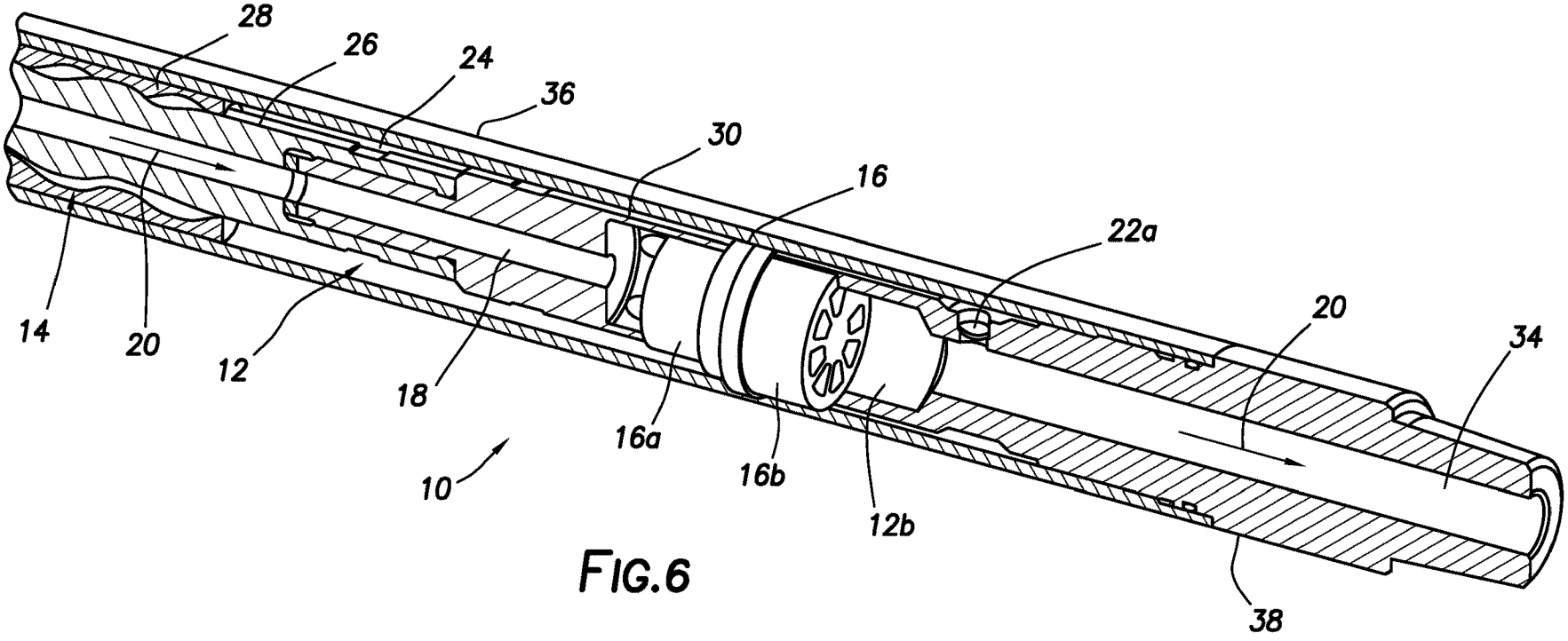
FIG. 6 is a representative perspective cross-sectional view of the lower portion of the fluid pulse generator section.

Referring specifically now to FIG. 6, a lower portion of the fluid pulse generator 12 is depicted after the upper rupture disk 22*b* has been opened. The fluid 20 now flows through the bypass flow path 18 to the ported component 30.

If the upper restrictor element 16*a* of the variable flow restrictor 16 is positioned relative to the lower restrictor element 16*b* so that relatively unrestricted flow is permitted between the restrictor elements, then the fluid 20 can flow to the outlet 34 in the lower connector 38, and into the tubular string downstream of the fluid pulse generator 12. However, if the upper restrictor element 16*a* is positioned so that flow between the restrictor elements 16*a,b* is blocked or substantially restricted, a pressure differential can be applied across the variable flow restrictor 16.

Pressure upstream of the variable flow restrictor 16 is communicated to the annulus 24 via the ports 42 in the component 30 (see FIG. 4). Thus, the pressure differential across the variable flow restrictor 16 is also applied across the rupture disk 22*a*. If the pressure differential reaches a predetermined level, the rupture disk 22*a* will open and thereby permit relatively unrestricted flow between the annulus 24 and the outlet 34.

In summary, if the flow of the fluid 20 through the fluid pulse generator 12 becomes blocked or substantially restricted (such as, if the flow between the rotor 26 and the stator 28 is blocked), the upper rupture disk 22*b* can be opened by applying a predetermined pressure differential to thereby permit flow through the bypass flow path 18. If flow through the variable flow restrictor 16 is blocked or substantially restricted, the lower rupture disk 22*a* can be opened by applying a predetermined pressure differential to thereby permit flow from the bypass flow path 18 to the outlet 34. The predetermined pressure differentials needed to open the lower and upper rupture disks 22*a,b* may be the same or they may be different.

Figure 7:
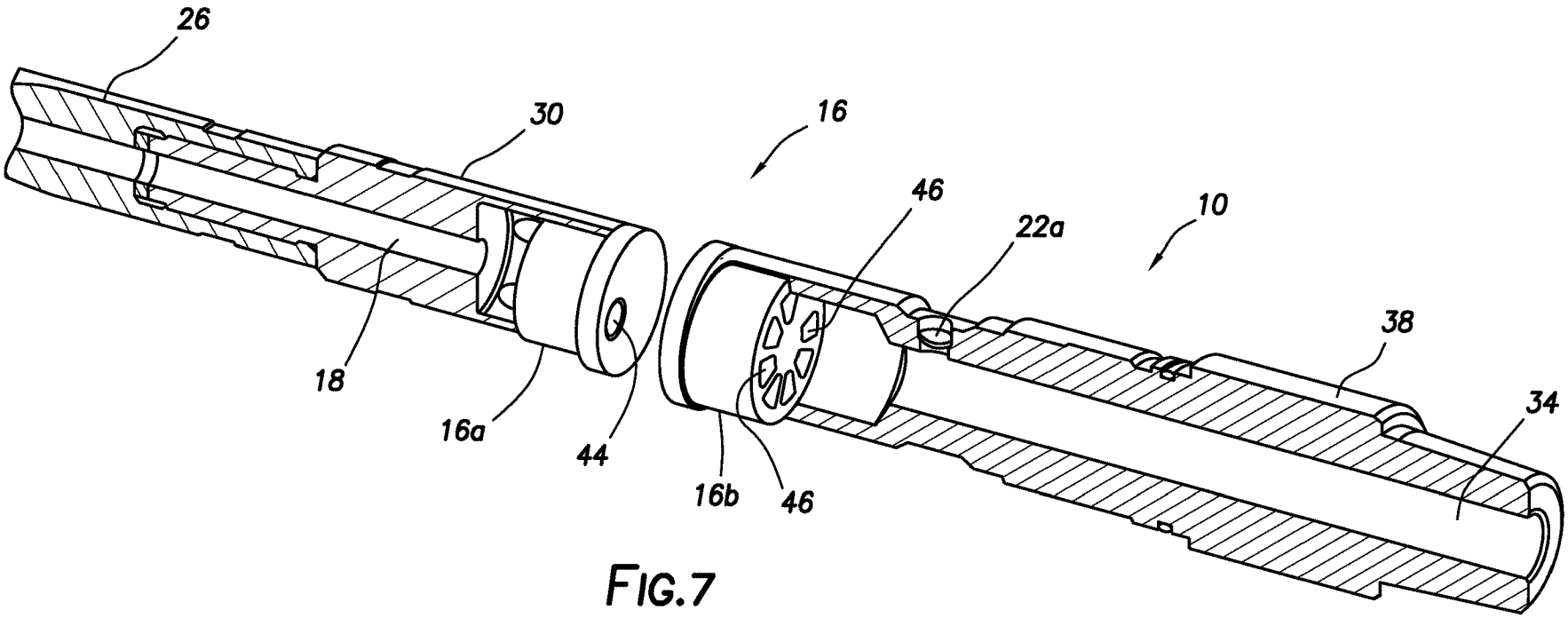
FIG. 7 is a representative bottom perspective exploded view of an example of a variable flow restrictor of the fluid pulse generator section.

Referring specifically now to FIG. 7, the manner in which the flow between the restrictor elements 16*a,b* of the variable flow restrictor 16 can be varied is more clearly visible. In this view, it may be seen that a flow path 44 is formed through the restrictor element 16*a*. The flow path 44 rotates relative to the restrictor element 16*b* when the restrictor element 16*a* is rotated by the rotor 26.

Multiple flow paths 46 are formed through the restrictor element 16*b*. The flow paths 46 are in communication with each other via a recess 48 formed in an upper surface 50 of the restrictor element 16*b* (see FIG. 9). However, a portion of the upper surface 50 traversed by the flow path 44 in the restrictor element 16*a* when it rotates does not have the recess 48 formed therein, so flow from the flow path 44 to the recess 48 and the flow paths 46 is periodically blocked as the restrictor element 16*a* rotates relative to the restrictor element 16*b*.

Figure 8:
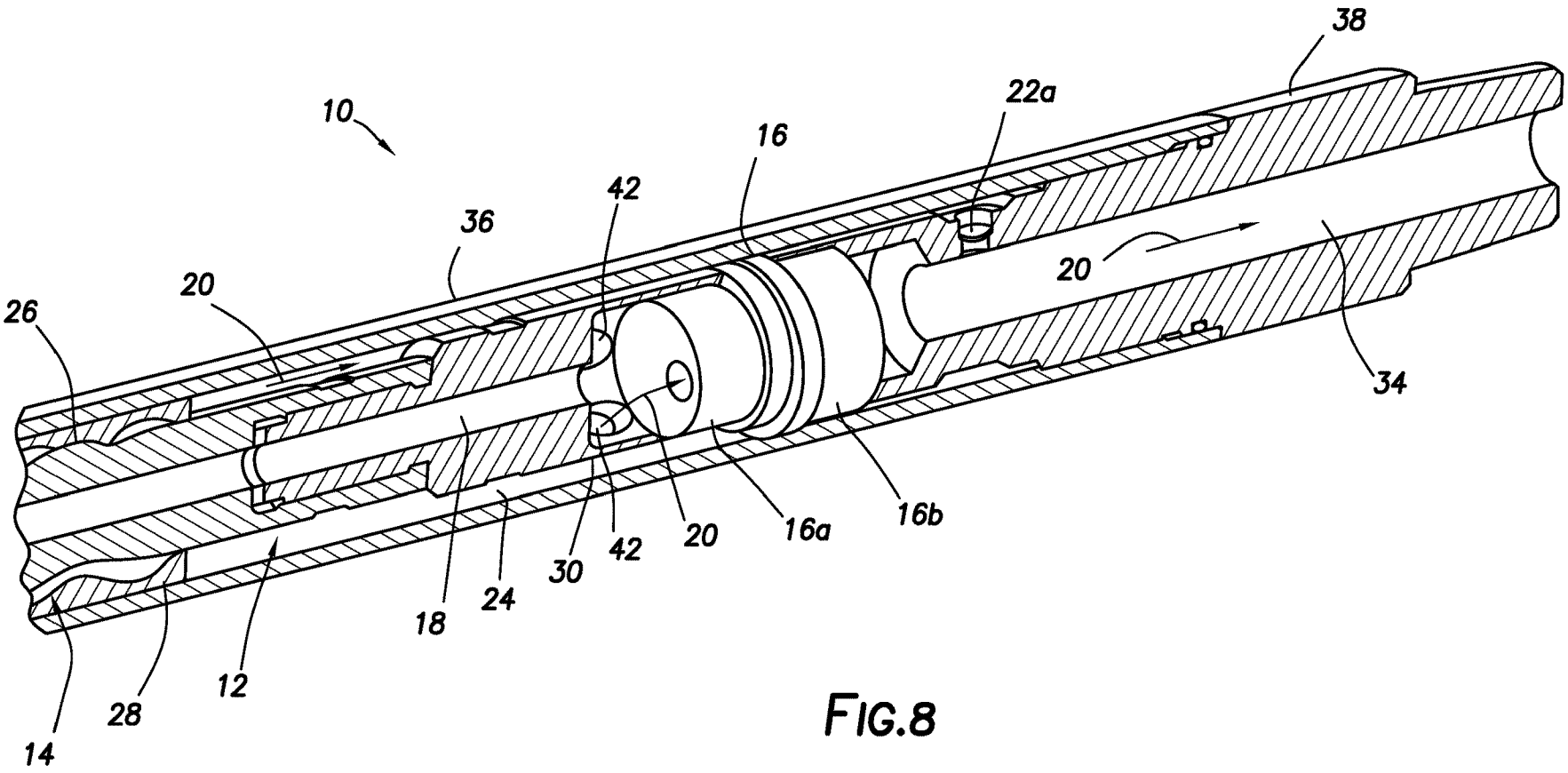
FIG. 8 is a representative perspective partially cross-sectional view of the lower portion of the fluid pulse generator section.

Referring specifically now to FIG. 8, it may be seen that, when the restrictor element 16*a* is positioned so that the flow path 44 is aligned with the recess 48, flow of the fluid 20 from the restrictor element 16*a* to the restrictor element 16*b* is relatively unrestricted. Thus, the fluid 20 can flow from the annulus 24 to the outlet 34 in the lower connector 38 in normal operation, or from the bypass flow path 18 to the outlet 34 if the upper rupture disk 22*b* has been opened.

Figure 9:
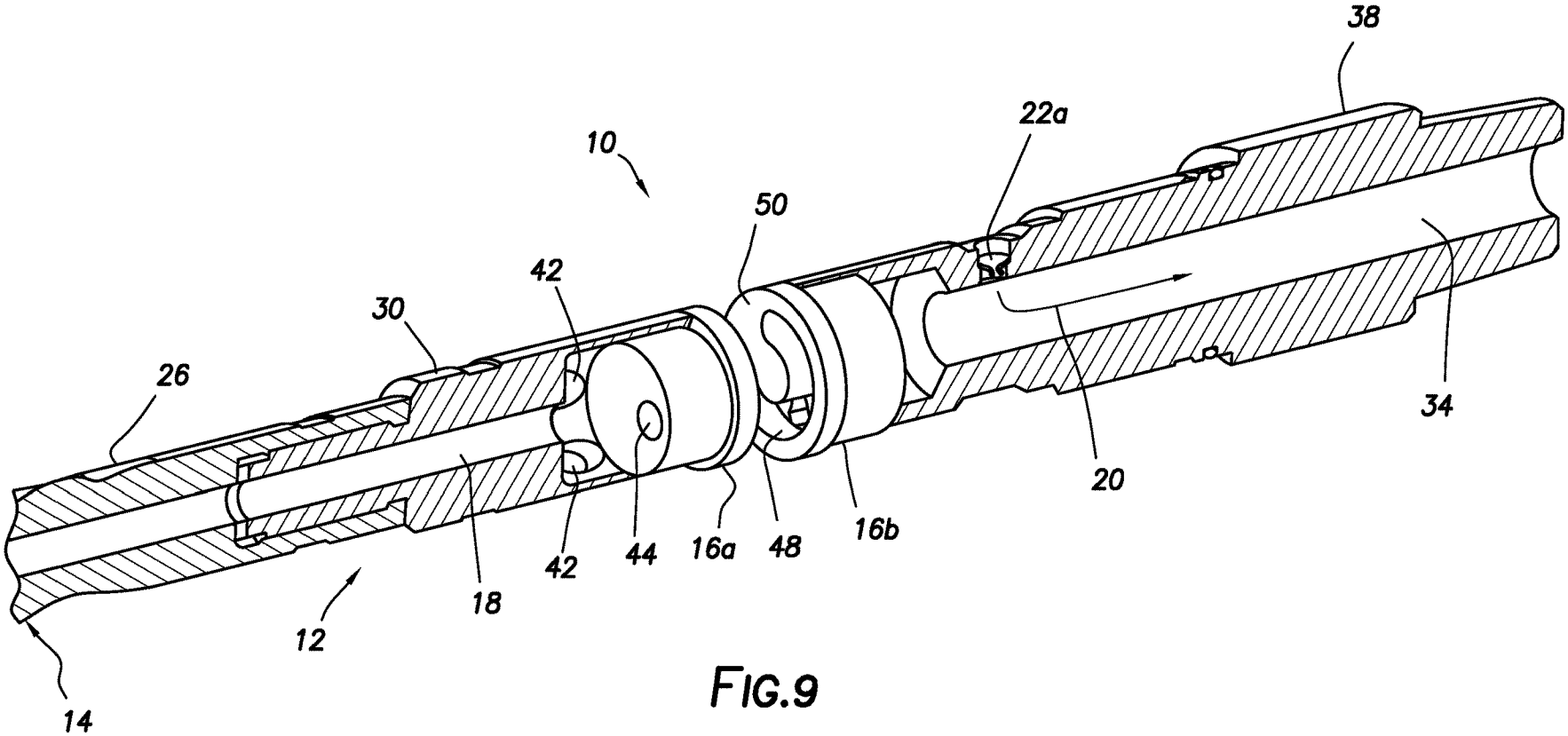
FIG. 9 is a representative top perspective exploded view of the variable flow restrictor of the fluid pulse generator section.

Referring specifically now to FIG. 9, it may be seen that, when the lower rupture disk 22*a* is opened, the fluid 20 can flow from the annulus 24 (see FIG. 8) to the outlet 34 via the open rupture disk. Typically, a sufficient pressure differential would not be applied across the rupture disk 22*a* to open the rupture disk, unless the flow of the fluid 20 through the variable flow restrictor 16 is blocked or substantially restricted.

It may now be fully appreciated that the above disclosure provides significant advancements to the art of generating fluid pulses in subterranean wells. In examples described above, fluid pulses are generated by flowing a fluid 20 through a fluid motor 14 of the fluid pulse generator 12. If desired, the fluid flow can bypass the fluid motor 14 by applying a predetermined pressure differential across a flow control device 22. In some examples, the flow control device 22 can comprise two separate flow control devices 22*a,b*.

The above disclosure provides to the art a fluid pulse generator 12 for use in a subterranean well. In one example, the fluid pulse generator 12 can comprise: an inlet 32 and an outlet 34, a fluid motor 14 in fluid communication with the inlet 32 and the outlet 34, a bypass flow path 18 in fluid communication with the inlet 32 and the outlet 34, and a first flow control device 22*b* configured to permit flow through the bypass flow path 18 in response to a first predetermined pressure differential applied across the first flow control device 22*b*.

The fluid pulse generator 12 can also include a variable flow restrictor 16 including a restrictor element 16*a* rotatable by the fluid motor 14, and a second flow control device 22*a* configured to permit flow from the bypass flow path 18 to the outlet 34 in response to a second predetermined pressure differential applied across the variable flow restrictor 16. The second flow control device 22*a* may comprise a rupture disk having a side exposed to pressure in an annulus 24 which receives fluid 20 discharged from the fluid motor 14, and an opposite side exposed to pressure in the outlet 34.

The bypass flow path 18 may be in fluid communication with the annulus 24. The flow from the bypass flow path 18 to the outlet 34 may not pass through the variable flow restrictor 16 when the second flow control device 22*a* is open.

The bypass flow path 18 may extend longitudinally through a rotor 26 of the fluid motor 14. The first pressure differential may comprise a difference between pressure in the inlet 32 and pressure in the outlet 34.

A method of generating fluid pulses in a subterranean well is also provided to the art by the above disclosure. In one example, the method can include: connecting a fluid pulse generator 12 in a tubular string 100, flowing a fluid 20 through the fluid pulse generator 12 in the well, thereby generating the fluid pulses, and then applying a first predetermined pressure differential from an inlet 32 to an outlet 34 of the fluid pulse generator 12, thereby permitting flow of the fluid 20 through the fluid pulse generator 12 without generating the fluid pulses.

The step of permitting the flow of the fluid 20 through the fluid pulse generator 12 without generating the fluid pulses may include permitting the flow of the fluid 20 through a bypass flow path 18 from the inlet 32 to the outlet 34. The step of permitting the flow of the fluid 20 through the bypass flow path 18 may include permitting the flow of the fluid 20 longitudinally through a rotor 26 of a fluid motor 14 of the fluid pulse generator 12.

The step of permitting the flow of the fluid 20 through the fluid pulse generator 12 without generating the fluid pulses may include permitting the flow of the fluid 20 through a first flow control device 22*b*. The step of permitting the flow of the fluid 20 through the fluid pulse generator 12 without generating the fluid pulses may include applying a second predetermined pressure differential from the inlet 32 to the outlet 34.

The method may include permitting the flow of the fluid 20 through a second flow control device 22*a* in response to the step of applying the second predetermined pressure differential from the inlet 32 to the outlet 34. The step of applying the second predetermined pressure differential may include applying the second predetermined pressure differential across a variable flow restrictor 16 of the fluid pulse generator 12.

Also described above is a fluid pulse generation system 10 for use with a subterranean well. In one example, the system 10 can include a fluid pulse generator 12 which receives a flow of a fluid 20 through a tubular string 100 in the well. The fluid pulse generator 12 includes a fluid motor 14, a variable flow restrictor 16 driven by the fluid motor 14, and a bypass flow path 18. A predetermined pressure differential applied across the fluid motor 14 permits the flow of the fluid 20 through the bypass flow path 18.

The bypass flow path 18 may extend longitudinally through a rotor 26 of the fluid motor 14. The bypass flow path 18 may be in fluid communication with an annulus 24 that receives the flow of the fluid 20 from the fluid motor 14.

The predetermined pressure differential may open a flow control device 22 connected in the bypass flow path 18. The fluid pulse generator 12 may include first and second flow control devices 22*a,b*, the first flow control device 22*b* selectively permitting fluid communication between an inlet 32 of the fluid pulse generator 12 and the bypass flow path 18, and the second flow control device 22*a* selectively permitting fluid communication between the bypass flow path 18 and an outlet 34 of the fluid pulse generator 12.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A fluid pulse generator for use in a subterranean well, the fluid pulse generator comprising:

an inlet and an outlet;

a fluid motor in fluid communication with the inlet and the outlet;

a variable flow restrictor including a restrictor element rotatable by the fluid motor;

a bypass flow path in fluid communication with the inlet and the outlet;

a first flow control device configured to permit flow through the bypass flow path in response to a first predetermined pressure differential applied across the first flow control device; and a second flow control device configured to permit flow from the bypass flow path to the outlet in response to a second predetermined pressure differential applied across the variable flow restrictor.

2. The fluid pulse generator of claim 1, in which the second flow control device comprises a rupture disk having a side exposed to pressure in an annulus which receives fluid discharged from the fluid motor, and an opposite side exposed to pressure in the outlet.

3. The fluid pulse generator of claim 2, in which the bypass flow path is in fluid communication with the annulus.

4. The fluid pulse generator of claim 1, in which the flow from the bypass flow path to the outlet does not pass through the variable flow restrictor when the second flow control device is open.

5. The fluid pulse generator of claim 1, in which the bypass flow path extends longitudinally through a rotor of the fluid motor.

6. The fluid pulse generator of claim 1, in which the first pressure differential comprises a difference between pressure in the inlet and pressure in the outlet.

7. A method of generating fluid pulses in a subterranean well, the method comprising:

connecting a fluid pulse generator in a tubular string;

flowing a fluid through the fluid pulse generator in the well, thereby generating the fluid pulses;

then applying a first predetermined pressure differential from an inlet to an outlet of the fluid pulse generator, thereby permitting flow of the fluid through the fluid pulse generator without generating the fluid pulses, in which the permitting the flow of the fluid through the fluid pulse generator without generating the fluid pulses comprises permitting the flow of the fluid through a first flow control device, and in which the permitting the flow of the fluid through the fluid pulse generator without generating the fluid pulses further comprises applying a second predetermined pressure differential from the inlet to the outlet; and permitting the flow of the fluid through a second flow control device in response to the applying the second predetermined pressure differential from the inlet to the outlet.

8. The method of claim 7, in which the permitting the flow of the fluid through the fluid pulse generator without generating the fluid pulses comprises permitting the flow of the fluid through a bypass flow path from the inlet to the outlet.

9. The method of claim 8, in which the permitting the flow of the fluid through the bypass flow path comprises permitting the flow of the fluid longitudinally through a rotor of a fluid motor of the fluid pulse generator.

10. The method of claim 7, in which the applying the second predetermined pressure differential comprises applying the second predetermined pressure differential across a variable flow restrictor of the fluid pulse generator.

11. A fluid pulse generation system for use with a subterranean well, the system comprising:

a fluid pulse generator which receives a flow of a fluid through a tubular string in the well, in which the fluid pulse generator comprises a fluid motor, a variable flow restrictor driven by the fluid motor, and a bypass flow path, in which a predetermined pressure differential applied across the fluid motor permits the flow of the fluid through the bypass flow path, and in which the fluid pulse generator further comprises first and second flow control devices, the first flow control device selectively permitting fluid communication between an inlet of the fluid pulse generator and the bypass flow path, and the second flow control device selectively permitting fluid communication between the bypass flow path and an outlet of the fluid pulse generator.

12. The system of claim 11, in which the bypass flow path extends longitudinally through a rotor of the fluid motor.

13. The system of claim 11, in which the bypass flow path is in fluid communication with an annulus that receives the flow of the fluid from the fluid motor.

14. The system of claim 11, in which the predetermined pressure differential opens a flow control device connected in the bypass flow path.

* * * * *